US007365759B2

(12) United States Patent
Hung et al.

(10) Patent No.: US 7,365,759 B2
(45) Date of Patent: Apr. 29, 2008

(54) THERMAL PRINT HEAD AND CONTROL METHOD THEREOF

(75) Inventors: Ming-Jiun Hung, Tai-Chung (TW); Feng-Ming Yang, Tai-Nan (TW)

(73) Assignee: Lite-On Technology Corp., Neihu, Taipei (TW)

( * ) Notice: Subject to any disclaimer, the term of this patent is extended or adjusted under 35 U.S.C. 154(b) by 206 days.

(21) Appl. No.: 11/306,659

(22) Filed: Jan. 5, 2006

(65) Prior Publication Data

US 2007/0085896 A1 Apr. 19, 2007

(30) Foreign Application Priority Data

Oct. 19, 2005 (TW) ..... 94136550 A

(51) Int. Cl.
*B41J 2/355* (2006.01)

(52) U.S. Cl. ..... 347/182

(58) Field of Classification Search ..... 347/180–182; 400/120.05, 120.06
See application file for complete search history.

(56) References Cited

U.S. PATENT DOCUMENTS 5,412,406 A * 5/1995 Fujimoto ..... 347/180
5,442,381 A * 8/1995 Fukubeppu et al. ..... 347/182

FOREIGN PATENT DOCUMENTS

JP 6-115137 * 4/1994 ..... 347/182

* cited by examiner

*Primary Examiner*—Huan Tran
(74) *Attorney, Agent, or Firm*—Winston Hsu

(57) ABSTRACT

A thermal print head is disclosed including plural driver circuits, each for driving plural heating elements; and a strobe signal generator for generating a plurality of strobe signals of different timings in which each strobe signal is coupled to a part of the plurality of driver circuits. The plural driver circuits operate simultaneously according to the plurality of strobe signals.

6 Claims, 3 Drawing Sheets

THERMAL PRINT HEAD AND CONTROL METHOD THEREOF

BACKGROUND OF THE INVENTION

1. Field of the Invention

The present invention relates to thermal printing techniques, and more particularly, to thermal print heads of the thermal sublimation/transfer printers and associated control methods.

2. Description of the Prior Art

In general, color printers can be classified into four major categories: dot matrix printers, inkjet printers, laser printers, and thermal sublimation (or thermal transfer) printers. Recently, the thermal sublimation printers have become increasingly popular due to their full tone printing performance. A thermal sublimation printer drives its thermal print head (TPH) to heat ribbons containing dyes to transfer the dyes onto an object to be printed. By this way, continuous-tone can be formed on the object according to the heating time or the heating temperature.

Please refer to FIG. 1, which shows a schematic diagram of a conventional thermal print head 100. As shown, the thermal print head 100 is provided with a plurality of driver circuits 110. Each driver circuit 110 loads printing data in accordance with an operating clock signal and then latches the loaded data under the control of a latch signal. Afterward, a strobe signal is employed by the thermal print head 100 to control each driver circuit 110 to drive coupled plural heating elements. Each heating element is arranged for heating an image dot, i.e., a pixel of the image to be printed. While the thermal print head 100 prints pixel data of a row, all driver circuits are controlled by the strobe signal to simultaneously drive corresponding heating elements. Therefore, considerable power consumption is required for supporting such operation of the thermal print head 100.

One conventional method for reducing the power consumption of the thermal print head 100 is to divide the image data of a row into two parts: one part is composed of odd pixels while the other part is composed of even pixels. Then, the two parts are printed in turn. For example, the thermal print head 100 can firstly print odd pixels of a row and then print even pixels of the row after the odd pixels are printed completely. Such a printing method can reduce the required power consumption of the thermal print head 100, but it doubles the printing time and increases the complexity of the firmware control of the thermal sublimation printer.

SUMMARY OF THE INVENTION

It is therefore an objective of the claimed invention to provide thermal print heads with merits of both high printing speed and low power consumption and control methods thereof to solve the above-mentioned problems.

According to the exemplary embodiment, a thermal print head is disclosed comprising: plural driver circuits, each for driving a plurality of heating elements; and a strobe signal generator for generating a plurality of strobe signals of different timings in which each strobe signal is coupled to a part of the plural driver circuits; wherein the plural driver circuits operate simultaneously according to the plurality of strobe signals.

According to the exemplary embodiment, a method for controlling a thermal print head having plural driver circuits in which each driver circuit is for driving plural heating elements is disclosed. The method involves: generating a plurality of strobe signals of different timings; and simultaneously utilizing the plurality of strobe signals to control the plural driver circuits with each strobe signal controlling a part of the plural driver circuits.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
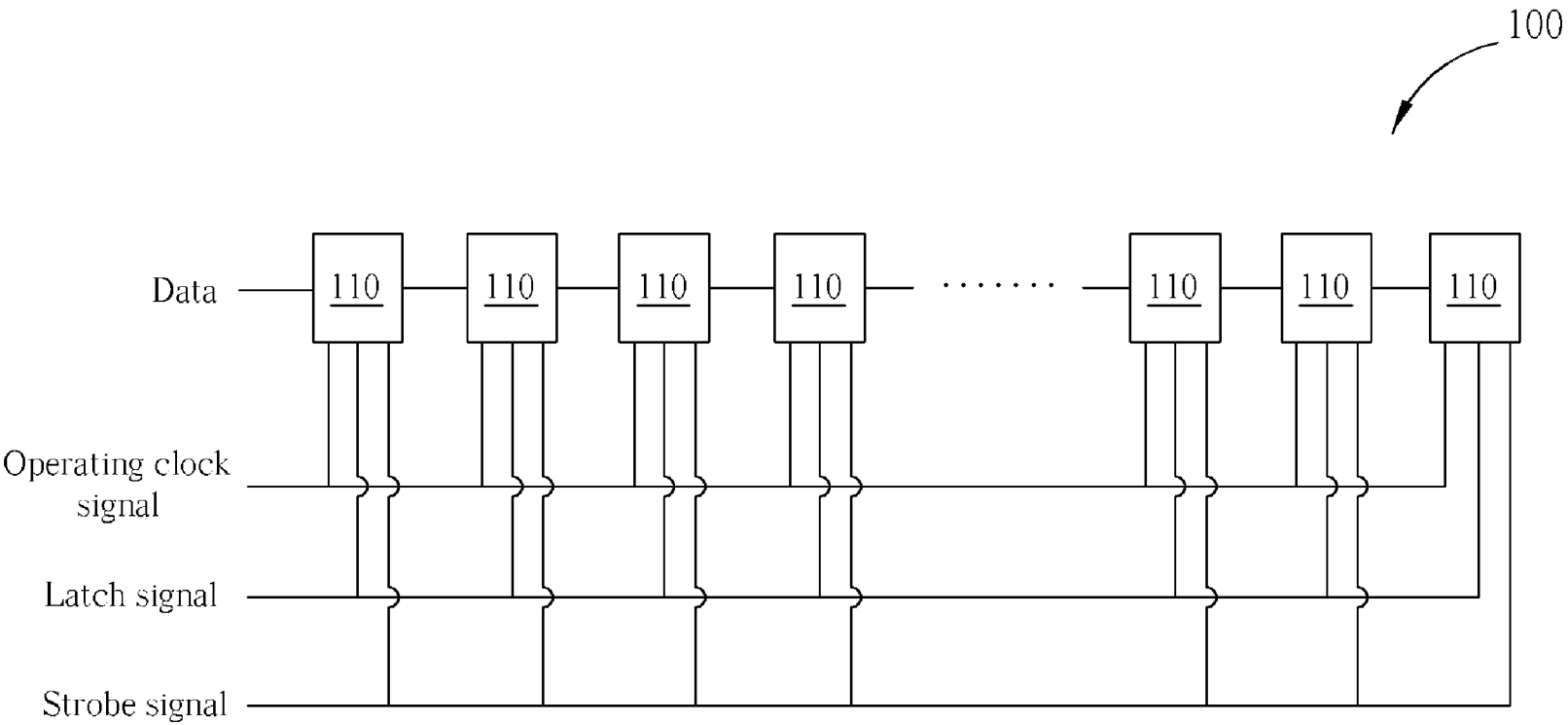
Fig. 1 Prior Art
FIG. 1 is a schematic diagram of a conventional thermal print head.
Figure 2:
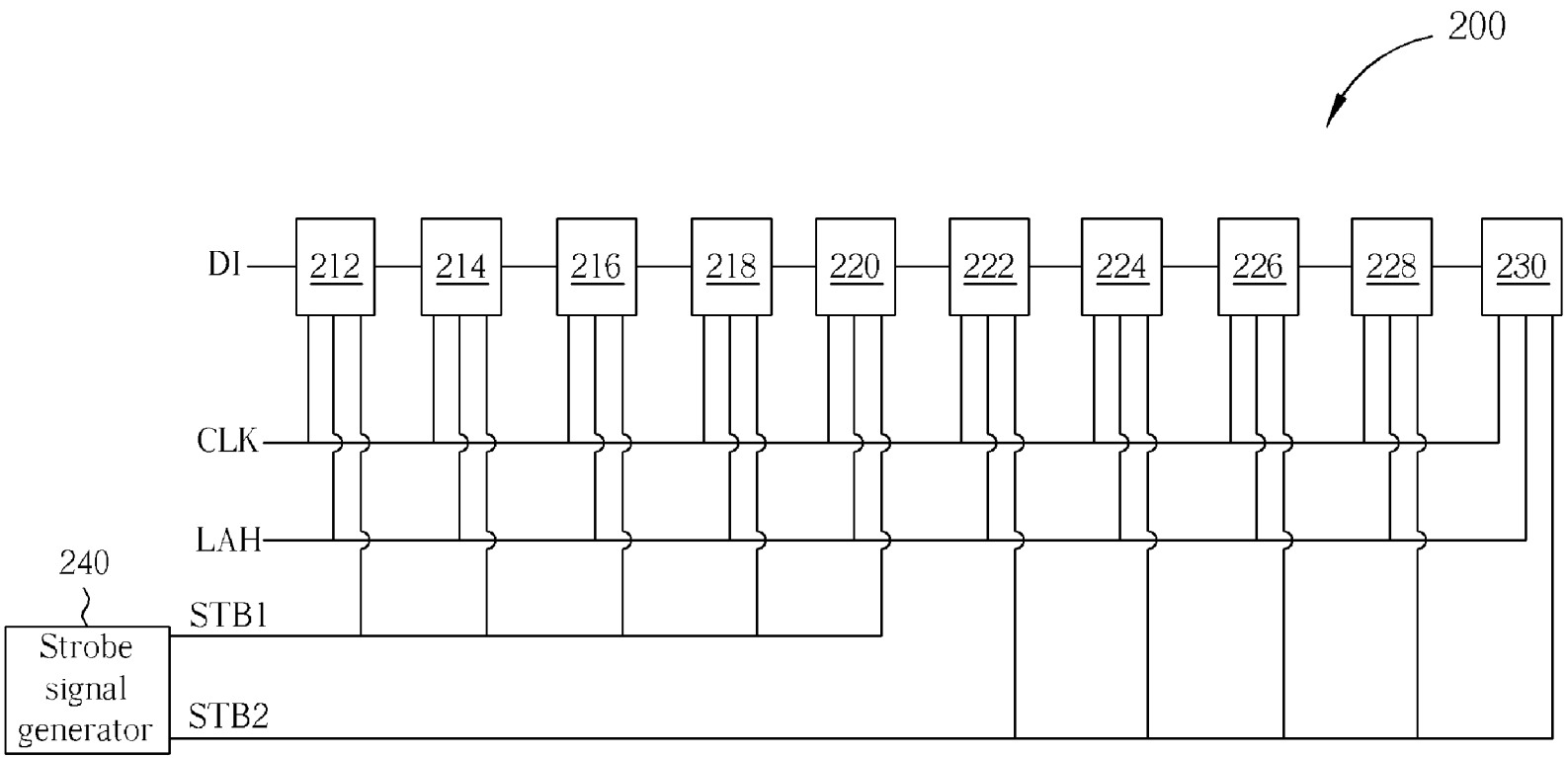
FIG. 2 is a schematic diagram of a thermal print head according to one embodiment of the present invention.

Please refer to FIG. 2, which shows a schematic diagram of a thermal print head 200 according to one embodiment of the present invention. In this embodiment, the thermal print head 200 comprises ten driver circuits 212~230, and a strobe signal generator 240. Each driver circuit is arranged for driving plural heating elements (not shown). The strobe signal generator 240 is arranged for generating a first strobe signal STB1 and a second strobe signal STB2 in which the timings of the first and second strobe signals STB1 and STB2 are different. As shown in FIG. 2, the first strobe signal STB1 is coupled to the first five driver circuits 212, 214, 216, 218, and 220 of the thermal print head 200, and the second strobe signal STB2 is coupled to another five driver circuits 222, 224, 226, 228, and 230.

In addition, each driver circuit of the thermal print head 200 is also coupled to an operating clock signal CLK and a latch signal LAH. The operating clock signal CLK and the latch signal LAH are typically generated by a control circuit of a thermal sublimation printer with the thermal print head 200. The way to generate the operating clock signal CLK and the latch signal LAH are well known in the art, and further details are therefore omitted herein for brevity. The operating clock signal CLK is employed to control the timing of loading of print data D1 into each driver circuit. After the print data are loaded into those driver circuits, the latch signal LAH controls each driver circuit to latch the loaded data. In this embodiment, the latch signal LAH, the first strobe signal STB1, and the second strobe signal STB2 are low active, but this is merely an example rather than a restriction of the practical implementations. Hereinafter, the operations of the thermal print head 200 will be further explained with reference to FIG. 3.

Figure 3:
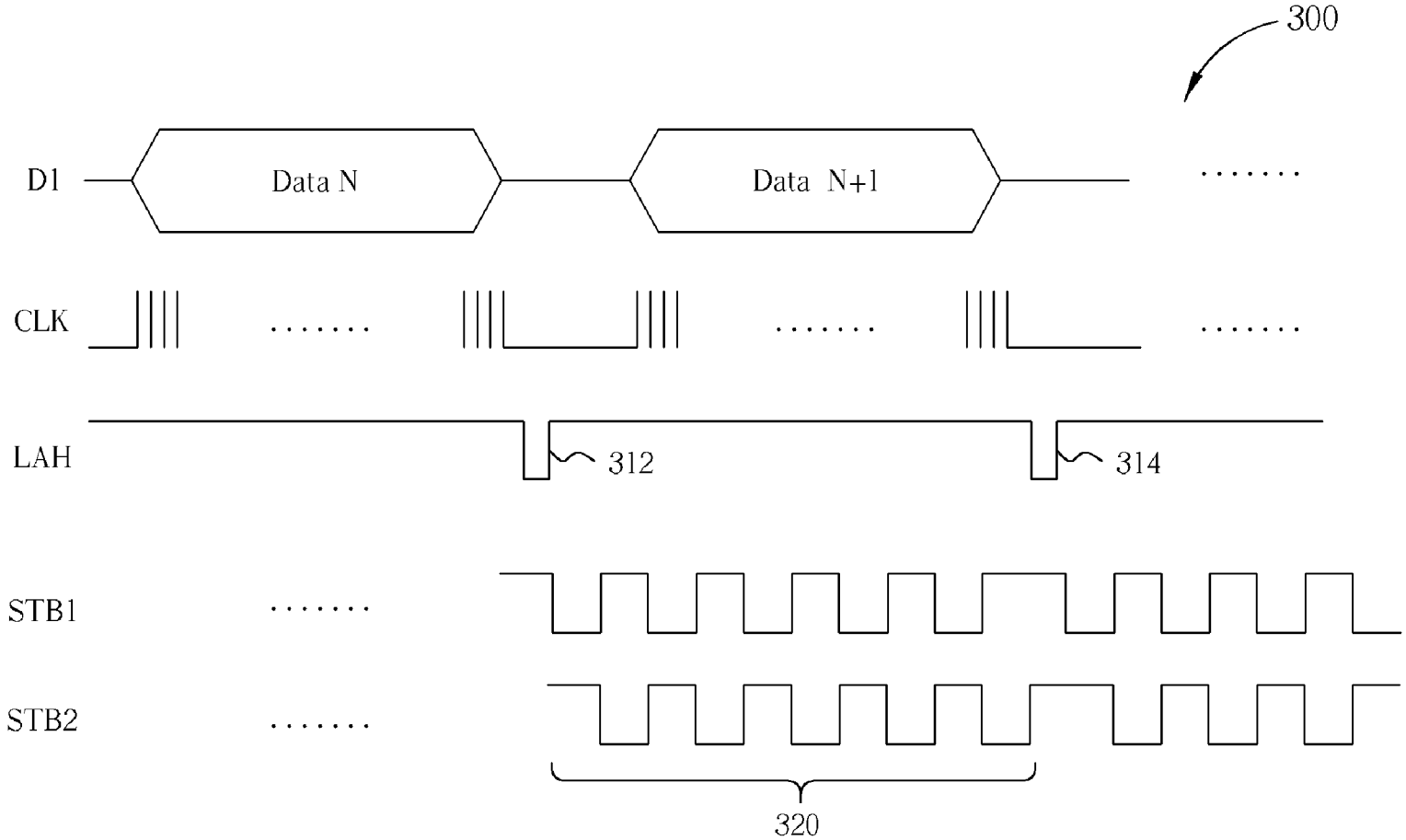
FIG. 3 is a timing diagram of the thermal print head of FIG. 2 according to one embodiment of the present invention.

FIG. 3 depicts a timing diagram 300 of the thermal print head 200 according to one embodiment of the present invention. When the thermal sublimation printer prints images, the thermal print head 200 heats yellow (Y) ribbon, magenta (M) ribbon, and cyan (C) ribbon, respectively. Since the heating operations for respective colors are similar, the heating operation for one of them is taken as an example in the following descriptions and for the sake of brevity, the heating operations for the remaining colors are omitted herein. In operations, color levels of print data D1 to be printed are loaded to the ten driver circuits 212~230 of the thermal print head 200 together with the operating clock signal CLK. After color level data N are loaded, each of the driver circuits 212~230 latches the loaded data according to an active pulse 312 of the latch signal LAH. Afterward, during a heating period 320 corresponding to the color level data N, each of the first five driver circuits 212, 214, 216, 218, and 220 of the thermal print head 200 drives connected heating elements according to the first strobe signal STB1. Simultaneously, each of the last five driver circuits 222, 224, 226, 228, and 230 of the thermal print head 200 drives connected heating elements according to the second strobe signal STB2. In one embodiment, the heating duration of each heating element is determined by the color level of the corresponding pixel, and the heating temperature of the heating element is controlled by the corresponding strobe signal.

If the heating element continuously heats for too long, it will burn out. To avoid this, both the first and second strobe signals STB1 and STB2 control coupled driver circuits with clock pulses as shown in FIG. 3. As mentioned above, the first strobe signal STB1 and the second strobe signal STB2 of this embodiment are low active. Accordingly, when the first strobe signal STB1 is at high level, the first five driver circuits 212, 214, 216, 218, and 220 of the thermal print head 200 do not drive any heating element. When the first strobe signal STB1 is at low level, each of the five driver circuits 212, 214, 216, 218, and 220 determines whether or not to drive each connected heating element according to the color level data corresponding to the heating element. Similarly, when the second strobe signal STB2 is at high level, the last five driver circuits 222, 224, 226, 228, and 230 of the thermal print head 200 do not drive any heating element. When the second strobe signal STB2 is switched to low level, each of the driver circuits 222, 224, 226, 228, and 230 determines whether or not to drive each connected heating element according to the color level data corresponding to the heating element.

In this embodiment, the first strobe signal STB1 and the second strobe signal STB2 are alternatively set to an active level during the heating period 320, and the first strobe signal STB1 and the second strobe signal STB2 are respectively set to the active level a plurality of times during the heat period of printing a pixel data. In other words, the first strobe signal STB1 and the second strobe signal STB2 do not be at the low level at the same time within the heating period 320. Therefore, there are at most half of the driver circuits of the thermal print head 200 drive heating elements at any time point within the heating period 320. Accordingly, there are at most half of the heating elements of the thermal print head 200 performing heating operation simultaneously. Specifically, the last five driver circuits stop their driving operations when the first five driver circuits of the thermal print head 200 drive heating elements, and the first five driver circuits stop their driving operations when the last five driver circuits drive heating elements. Note that the pulse number of the first strobe signal STB1 and the second strobe signal STB2 shown in FIG. 3 is merely an embodiment rather than a restriction of the practical implementations.

During the heating operations in accordance with the color level data N, the thermal print head 200 can load the next color level data (i.e., color level data N+1) into respective driver circuits. When the heating operation for the color level data N is completed, each of the driver circuits 212~230 latches the newly loaded color level data N+1 according to an active pulse 314 of the latch signal LAH. As a result, the thermal print head 200 can immediately start the heating operation for the color data N+1 after the heating operation for the color data N is done.

In one aspect of the present invention, the ten driver circuits of the thermal print head 200 can be regarded as two groups of driver circuits, which are a first group composed of the first five driver circuits and a second group composed of the last five circuits, respectively controlled by the first strobe signal STB1 and the second strobe signal STB2. As in the foregoing descriptions, the heating elements corresponding to the two groups heat the ribbon simultaneously in an interleaved manner as shown in FIG. 3. Thus, the disclosed architecture of the thermal print head 200 can significantly reduce the required power consumption without delaying the printing speed.

Please note that, the number of driver circuits arranged in the thermal print head 200 is merely an embodiment rather than a restriction of the practical applications. In addition, the number of strobe signals generated by the strobe signal generator 240 is not limited to two as in the foregoing embodiment. In practice, the strobe signal generator 240 may generate three or more strobe signals of different timings and utilize these strobe signals to control different groups of driver circuits of the thermal print head 200. The power consumption of the thermal print head 200 can be reduced, if none of those strobe signals completely overlaps the active period of another.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A thermal print head comprising:

plural driver circuits, each for driving a plurality of heating elements; and a strobe signal generator for generating a plurality of strobe signals of different timings in which each strobe signal is coupled to some of the plural driver circuits;

wherein the plural driver circuits operate simultaneously according to the plurality of strobe signals; the plurality of strobe signals are alternatively set to an active level during a period of printing a pixel data; and each strobe signal is set to the active level a plurality of times during the period of printing a pixel data.

2. The thermal print head of claim 1, wherein each strobe signal is coupled to the same amount of driver circuits.

3. The thermal print head of claim 1, wherein none of the plurality of strobe signals completely overlaps the active period of another.

4. A method for controlling a thermal print head that has plural driver circuits in which each driver circuit is for driving plural heating elements, the method comprising:

generating a plurality of strobe signals of different timings; and simultaneously utilizing the plurality of strobe signals to control the plural driver circuits with each strobe signal controlling a part of the plural driver circuits;

wherein the plurality of strobe signals are alternatively set to an active level during a period of printing a pixel data, and each strobe signal is set to the active level a plurality of times during the period of printing the pixel data.

5. The method of claim 4, wherein each strobe signal is employed to control the same amount of driver circuits.

6. The method of claim 4, wherein none of the plurality of strobe signals completely overlaps the active period of another.

* * * * *